US006519884B1

(12) United States Patent
Duhamel

(10) Patent No.: US 6,519,884 B1
(45) Date of Patent: Feb. 18, 2003

(54) STREET AND ROAD SIGN

(76) Inventor: Robert Duhamel, 740 Montpellier, Suite 206, St-Laurent, Québec (CA), H4L 5B1

( * ) Notice: Subject to any disclaimer, the term of this patent is extended or adjusted under 35 U.S.C. 154(b) by 1031 days.

(21) Appl. No.: 08/699,328

(22) Filed: Aug. 19, 1996

Related U.S. Application Data

(63) Continuation-in-part of application No. 08/195,449, filed on Feb. 14, 1994, now abandoned.

(51) Int. Cl.[7] ..... G09F 15/00

(52) U.S. Cl. ..... 40/612; 40/606; 40/607; D10/109; D10/111

(58) Field of Search ..... 40/606, 607, 612, 40/617; D10/111, 109

(56) References Cited

U.S. PATENT DOCUMENTS 1,327,387 A * 6/1920 Hockoday ..... 40/612
1,517,439 A * 12/1924 Like ..... 40/612
D236,444 S * 8/1975 Nelson ..... D10/111

OTHER PUBLICATIONS

1990 Uniform Sign Chart of the California Department of Transportation.*

Lectric Lites Co. Catalog, p. 6, Item W3–2 and W3–1.*

* cited by examiner

*Primary Examiner*—Cassandra H. Davis

(57) ABSTRACT

A road sign having a plate mounted on a post. The plate has a primary traffic symbol on one side providing first traffic information. There is at least one secondary traffic symbol on the one side of the plate providing secondary traffic information unrelated to the first traffic information. The secondary traffic symbol is in a position on the plate to indicate the general location of the secondary information relative to the sign.

3 Claims, 1 Drawing Sheet

STREET AND ROAD SIGN

This application is a continuation-in-part of application Ser. No. 08/195,449, filed Feb. 14, 1994, and now abandoned.

BACKGROUND OF THE INVENTION

1. Field of the Invention

This invention relates to traffic signs and more particularly to traffic signs of the type embodying, most of the time, a post and a permanent sign plate mounted at the upper end of the post. The sign plate carries primary traffic information which could, for example, be in the form of wording such as "STOP", "ARRET", "ARRET STOP" in the case of a stop sign. The sign plate itself, by its shape, can also convey the same primary traffic information, or reinforce the primary traffic information. The primary traffic information could be any instructions to expedite traffic and eliminate accidents.

2. Description of Related Art Including Information Disclosed Under 37 CFR §§1.97 and 1.98

The "Traffic Control Devices Handbook", hereinafter referred to as the "Handbook", 1983 edition, published by the U.S. Department of Transport under the Federal Highway Administration, discloses various known, standard traffic signs. The "Handbook" places the known highway signs in three categories. These categories are: regulatory signs, which inform drivers of traffic laws and regulations; warning signs, which warn drivers of traffic of unusual or potentially hazardous conditions on or adjacent a street or highway; and guide signs giving the driver simple and specific information to aid him in reaching his destination. In all categories however, particularly in the regulatory and warning categories, the signs convey only one traffic message. No secondary traffic message or information is imparted by the signs.

With the standard traffic signs, it is difficult, if not impossible, for a driver to determine from the signs he is approaching if there is any particular secondary traffic situation nearby that may present a danger. For example, if the driver is approaching an intersection, a standard stop sign on his road will tell him he has to stop but he cannot tell from this sign if the intersection is a one way, a two way, a three way or a four way stop and thus cannot tell until he reaches the intersection who might have the right-of-way.

SUMMARY OF THE INVENTION

It is, therefore, a particular object of this invention to provide a vehicle traffic sign with a novel, readily visible characteristic-other than the first primary traffic information provided in the form of wording on the sign and/or the shape of the sign-which serves to positively and quickly provide secondary traffic information. This secondary traffic information could, for example, locate an adjacent street corner with a stop sign, or indicate the same to an approaching driver who also has a stop to do at the same street intersection.

Another more general object of this invention is to indicate, on a known traffic sign, particular secondary traffic information for the driver to observe or watch for in the general area where the sign is located.

With the foregoing and other objects in view that will appear as the description proceeds, the invention consists of certain novel details of construction and graphic combinations hereinafter more fully described and pointed out in the claims, it is being understood that changes may be made in utilization, application or use, construction or fabrication, size or dimension, position, location, quantity, design and/or color of the shape, figure and/or sign without departing from the spirit of the invention as claimed.

DESCRIPTION OF THE PREFERRED EMBODIMENTS

Figure 1:
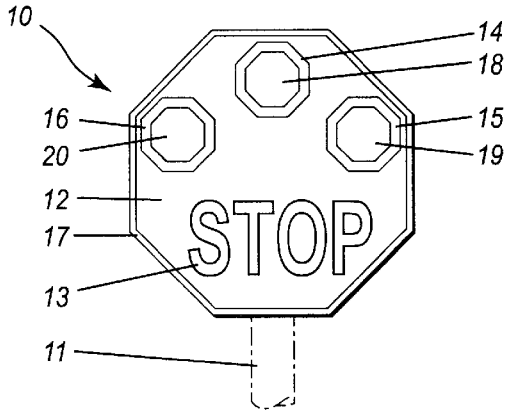
FIG. 1 is a front elevation view of a stop sign indicating a junction with a four way stop.

In accordance with the present invention, a stop sign, designated by the numeral 10 in FIG. 1, is constructed of sheet aluminum or other suitable material having an octagon shape. The octagon shape of the sign, a primary traffic symbol, immediately conveys to an approaching driver the primary traffic information that a stop is required where the sign is located. The stop sign 10 is attached in an upstanding position to a post 11 shown in dotted lines. To fix the sign 10 to the post 11 we use bolts and nuts, screws and/or rivets with or without an adapter or collar (not shown) depending on the kind of post to which the sign is attached. Most of the time the post carrying or supporting the sign is a metal channel, section or tube, galvanized and/or painted. In general, the sign 10 is located on the right side of the roadway, the front of the sign facing the oncoming traffic.

The front 12 of the sign 10 is covered with a self-adhesive reflective film, which could be printed or painted, and treated to provide a light reflecting surface or to be otherwise luminous for readily seeing the sign at night. The front surface 12 of the sign is any color prescribed by the ministry or highway authority and displayed thereon is another primary traffic symbol 13. This other primary traffic symbol 13, the word "stop" in the case of the stop sign, provides the approaching driver on the roadway with reinforcement of the first primary traffic information provided by the shape of the sign. Also on the front 12 of the sign are three secondary traffic symbols 14, 15 and 16 as will be described below. The edge 17 of the surface 12 is white in color or any color prescribed by the ministry or highway authority that is distinctive or noticeable. As well, the edge 17 can be made reflective or luminous, to enhance its visibility to an approaching driver.

The white color is proposed here for at least three reasons; ease of fabrication, integrity with the whole sign and because of its high visibility for the protanopic and protanomalous color-defective persons who drive.

The secondary traffic symbols 14, 15 and 16 on the front of the sign provide the approaching driver with secondary traffic information. This secondary traffic information is unrelated to the primary traffic information provided by the "stop" traffic symbol 13 and the shape of the sign. The secondary traffic symbols can have their center 18, 19 and 20 colored like the front 12 of the sign to make them distinctively noticeable.

The secondary traffic symbols 14, 15 and 16 are placed near the edge 17 of the sign but not touching it. This location, spaced from the edge of the sign, ensures that the symbols stand completely alone and are fully recognizable without confusion. The secondary traffic symbols are also preferably placed on the upper portion of the sign to give space for the main traffic symbol 13. This proposed arrangement allows the secondary traffic symbols and the main traffic symbol to be sized so as to provide an easy visibility. The location of each secondary traffic symbol on the sign provides the location of the secondary traffic information provided by the symbol to the approaching driver.

The secondary traffic symbols used on the sign can, for example, represent the shape of a standard regulatory or warning sign as given by the "Handbook". These shapes include: an octagon, a circle, a square, a rectangle with the long side vertical, a diamond, a triangle with a point pointing down, or a pentagon with the peak at the top. The regulatory signs also sometimes include signs having the shape of a rectangle with the long side horizontal but since such a sign is also mainly used as a guide sign, according to the "Handbook", this shape is not employed in the present invention because of the confusion it could create. Thus, the sign shapes used are limited to those shapes solely used in regulatory or warning signs as defined by the "Handbook". The secondary traffic symbols could also represent the shapes of objects associated with the regulatory and warning traffic signs such as a bicycle, a car, a truck, a pedestrian, a bump, a letter, a number, or an arrow head. The objects are used without an enclosing sign shape.

FIG. 1 particularly illustrates the sign 10 as being a stop sign both by its octagon shape, and by the main traffic symbol 13 being the word "stop". The stop sign is usually red in color with a white edge 17. The three secondary traffic symbols 14, 15 and 16 are also octagon shaped signifying stop signs. These symbols are preferably the same size and are smaller than the main traffic symbol 13. The stop sign is usually placed on the roadway near an intersection. The position of each of the secondary traffic symbols on the sign indicate which street leading to the intersection it is referring to.

The secondary traffic symbol 14 placed at the top of the sign 10 indicates that the opposite road leading to the intersection has a stop sign at the intersection. In other words the person in front of the sign 10 will know from the secondary traffic symbol 14 placed at the top of the sign 10, that the driver in a vehicle in front of him, coming in the opposite direction, has a stop sign indicating to him that he must stop his vehicle at this particular intersection. The secondary traffic symbol 15 placed on the right side of the sign 10 indicates that the right hand road leading to the intersection has a stop sign at the intersection. The person in front of the sign 10 will know from the secondary traffic symbol 15 placed on the right side of the sign 10, that the driver in a vehicle coming to the intersection from the right side, has a stop sign indicating to him that he must stop his vehicle at this particular intersection. Similarly, the secondary traffic symbol 16 on the left side of the sign 10 indicates to the person in front of the sign 10 that the driver in a vehicle coming to the intersection from the left side will have to stop.

The sign 10 of FIG. 1 is an example of a sign indicating a four way stop junction because we have used three secondary traffic symbols in the form of stop signs, on a stop sign, the symbols located in a specific arrangement on the stop sign.

Figure 2:
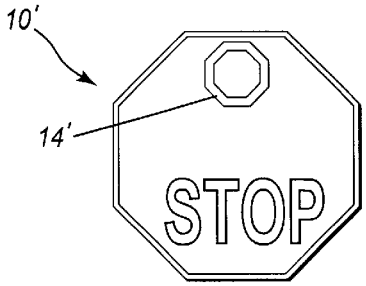
FIGS. 2, 3 and 4 are a front elevation view of a stop sign indicating a junction with a two way stop.

FIG. 2 illustrates a stop sign 10' having a single secondary traffic symbol 14' in the form of a small stop sign placed at the top of the sign 10'. This sign 10' indicates that the opposite adjacent street corner has a stop sign.

Figure 3:
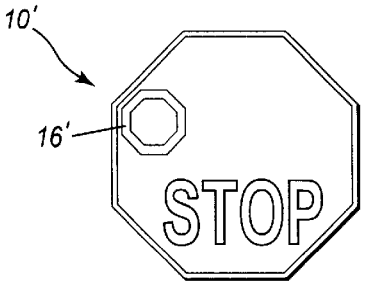

FIG. 3 illustrates a stop sign 10' having a single secondary traffic symbol 16' in the form of a small stop sign placed on the left side of the sign 10'. This sign 10' indicates that the left adjacent street corner has a stop sign.

Figure 4:
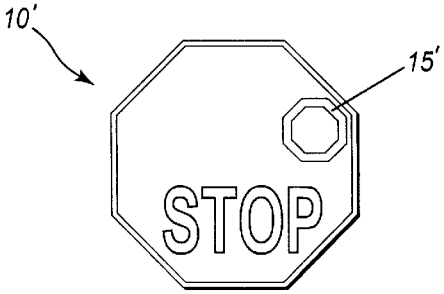

FIG. 4 illustrates a stop sign 10' having a single secondary traffic symbol 15' in the form of a small stop sign placed on the right side of the sign 10'. This sign 10' indicates that the right adjacent street corner has a stop sign.

FIGS. 2, 3 and 4 are examples of stop signs indicating a two way stop junction because we used, in these examples, one secondary traffic symbol in the shape of a stop sign on the sign.

Figure 5:
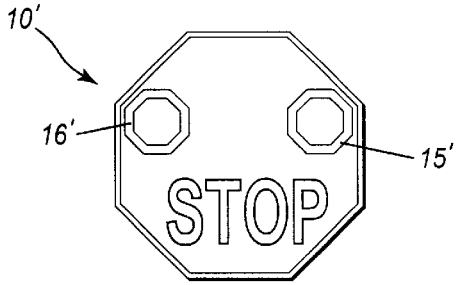
FIGS. 5, 6 and 7 are a front elevation view of a stop sign indicating a junction with a three way stop.

FIG. 5 illustrates a stop sign 10' displaying thereon two secondary traffic symbols in the shape of small stop signs 15' and 16'. The secondary traffic symbol 15' placed on the right side of the sign 10', indicates that the right adjacent street corner has a stop sign and the secondary traffic symbol 16' placed on the left side of the sign 10', indicates that the left adjacent street corner has a stop sign.

Figure 6:
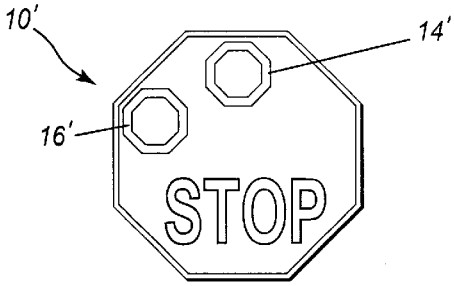

FIG. 6 illustrates a stop sign 10' displaying thereon two secondary traffic symbols in the shape of small stop signs 14' and 16'. The secondary traffic symbol 14' placed on the top of the sign 10', indicates that the opposite adjacent street corner has a stop sign and the secondary traffic symbol 16' placed on the left side of the sign 10', indicates that the left adjacent street corner has a stop sign.

Figure 7:
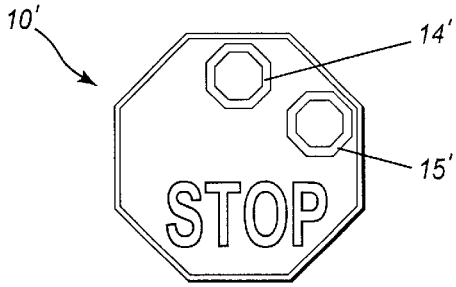

FIG. 7 illustrates a stop sign 10' displaying thereon two secondary traffic symbols in the shape of small stop signs 14' and 15'. The secondary traffic symbol 15' placed on the right side of the sign 10', indicates that the right adjacent street corner has a stop sign and the secondary traffic symbol 14' placed at the top of the sign 10', indicates that the opposite adjacent street corner has a stop sign.

FIGS. 5, 6 and 7 are examples of stop signs indicating a three way stop junction because we used, in these examples, two secondary traffic symbols in the shape of stop signs on the sign.

Figure 8:
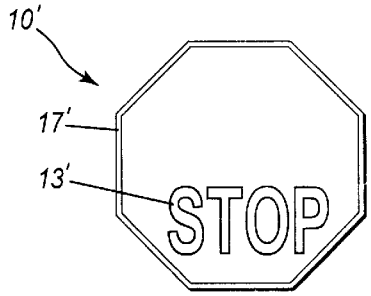
FIG. 8 is a front elevation view of a stop sign indicating a junction with a single way stop.

FIG. 8 illustrates a stop sign 10' displaying only the main traffic symbol 13'. This sign, when there is no secondary traffic symbol on it, tells the driver approaching the junction that he is the only one having a stop to do.

FIG. 8 is an example of a stop sign indicating a one way stop junction because no secondary traffic symbols were used on the sign.

In FIGS. 1 to 8 no secondary traffic symbols have been used at the bottom, or in the lower part of the sign because it would provide superfluous information. In some applications however a secondary traffic symbol may be used at the bottom of the sign.

For the sign described above, depending on the situation, no secondary traffic symbols to four secondary traffic symbols of the same shape, excluding the shape of the sign 10 itself, will be sufficient to convey the full information required. It is important to know the conditions under which the sign is to be employed to depict upon its face the arrangement of secondary traffic symbols required to indicate the conditions.

The traffic sign described above had a stop sign giving the primary traffic information and one or more small stop sign symbols, adjacent the periphery of the stop sign, giving the secondary traffic information. This traffic sign described is by way of example only. The primary traffic information is given by any regulatory or warning traffic sign as set out in the "Handbook". The secondary traffic information on the traffic sign is given by any symbol showing the shape of any sign used solely as a regulatory or warning traffic sign as set out in the "Handbook", and/or by any symbol, such as the objects described above, that will convey regulatory or warning traffic information.

The symbols used to give the secondary traffic information are pictographs since they are a pictorial symbol or a picture of something, which picture is taken by everyone as the conventional sign of an expression or idea. For example, the octagon shape of the secondary traffic symbol in the example given above immediately conveys a stop message to all drivers since the octagon shape is associated in traffic signage, as confirmed in the "Handbook", as forming a distinctive part of a stop sign. Similarly, a secondary traffic symbol with a triangle shape, with one point down, would immediately convey to all drivers a yield message since the triangle shape with the point down is associated in traffic signage as a distinctive part of a yield sign. Using pictographs eliminates the need for using the complete regulatory or warning sign.

I claim:

1. A traffic sign for installation adjacent a roadway having: a plate with a geometric shape defined by a peripheral edge; a post; the plate mounted on the post; a first traffic symbol on one side of the plate providing first traffic information; at least one secondary traffic symbol the one side of the plate providing secondary traffic information unrelated to the first traffic symbol and to the first traffic information provided by the first traffic symbol, the secondary traffic symbol located on the one side of the plate adjacent, but not touching, the peripheral edge of the plate; and wherein the plate has a top and the secondary traffic symbol is at least one octagon shape, the shape located at the top of the plate to indicate the general location of the secondary traffic information relative to the sign.

2. A traffic sign for installation adjacent a roadway having: a plate with a geometric shape defined by a peripheral edge; a post; the plate mounted on the post; a first traffic symbol on one side of the plate providing first traffic information; at least one secondary traffic symbol the one side of the plate providing secondary traffic information unrelated to the first traffic symbol and to the first traffic information provided by the first traffic symbol, the secondary traffic symbol located on the one side of the plate adjacent, but not touching, the peripheral edge of the plate; and wherein the plate has a top and the secondary traffic symbol is at least one octagon shape, the shape located on the left side of the plate to indicate the general location of the secondary traffic information relative to the sign.

3. A traffic sign for installation adjacent a roadway having: a plate with a geometric shape defined by a peripheral edge; a post; the plate mounted on the post; a first traffic symbol on one side of the plate providing first traffic information; at least one secondary traffic symbol the one side of the plate providing secondary traffic information unrelated to the first traffic symbol and to the first traffic information provided by the first traffic symbol, the secondary traffic symbol located on the one side of the plate adjacent, but not touching, the peripheral edge of the plate; and wherein the plate has a top and the secondary traffic symbol is at least one octagon shape, the shape located on the right side of the plate to indicate the general location of the secondary traffic information relative to the sign.

* * * * *